US005651540A

United States Patent [19]

Watanabe et al.

[11] Patent Number: 5,651,540

[45] Date of Patent: Jul. 29, 1997

[54] SHEET SUPPLY DEVICE WITH STACKING REFERENCE GUIDE

[75] Inventors: Yoshiaki Watanabe, Yokohama; Takao Sameshima, Yokosuka; Hiroaki Namiki, Kawasaki; Tomoyuki Araki, Tokyo; Ryukichi Inoue, Kawasaki; Kazuhide Kudo, Murayama; Akio Nemoto, Kawasaki, all of Japan

[73] Assignee: Canon Kabushiki Kaisha, Tokyo, Japan

[21] Appl. No.: 435,657

[22] Filed: May 5, 1995

Related U.S. Application Data

[62] Division of Ser. No. 095,230, Jul. 23, 1993, abandoned.

[30] Foreign Application Priority Data

Jul. 23, 1992 [JP] Japan ..... 4-225144
Jul. 16, 1993 [JP] Japan ..... 5-198897

[51] Int. Cl.[6] ..... B65H 5/00; B65H 9/16

[52] U.S. Cl. ..... 271/10.12; 271/225; 271/248; 271/250; 271/160; 271/164; 271/902

[58] Field of Search ..... 271/10.11, 126, 271/127, 225, 236, 248, 250, 251, 160, 162, 164, 170, 10.12, 10.01, 902

[56] References Cited

U.S. PATENT DOCUMENTS 3,583,697 6/1971 Tippy .
4,372,547 2/1983 Yanagawa et al. .
4,426,073 1/1984 Mizuma .
4,569,587 2/1986 Miyoshi et al. .
5,154,411 10/1992 Saito et al. .
5,284,333 2/1994 Ishikawa .

FOREIGN PATENT DOCUMENTS 39221 2/1992 Japan ..... 271/251
292345 10/1992 Japan ..... 271/170

*Primary Examiner*—Boris Milef
*Attorney, Agent, or Firm*—Fitzpatrick, Cella, Harper & Scinto

[57] ABSTRACT

A sheet supplying device having a sheet support for supporting sheets, a sheet supply provided in a laterally deviated position with respect to the sheet supplying direction for supplying sheets supported by the sheet support and a stacking reference guide for impinging on a lateral end of the sheets supported by the sheet support to thereby define the position of the sheets. The guide defining the position of the sheets is supported by the sheet support in such a manner that the sheets are supported in a state inclined by a predetermined angle with respect to the sheet supplying direction.

16 Claims, 15 Drawing Sheets

SHEET SUPPLY DEVICE WITH STACKING REFERENCE GUIDE

This application is a division of application Ser. No. 08/095,230, filed Jul. 23, 1993, now abandoned.

BACKGROUND OF THE INVENTION

1. Field of the Invention

The present invention relates to a sheet supply device for use in an image forming apparatus such as a copying machine, a printer, a facsimile apparatus or the like.

2. Related Background Art

For use in an image forming apparatus such as a copying machine, a printer, a facsimile apparatus or the like, there is known a sheet supplying cassette provided therein with reference guide members for one-side sheet supplying, at the upstream and downstream positions on a lateral face of the main body of the cassette, along the sheet supplying direction, for impinging on a lateral side, along the sheet supplying direction, of the sheets stacked in said main body.

FIG. 19 illustrates a conventional sheet supplying cassette, wherein, in a cassette main body 1, there is provided an inner plate 2 for supporting stacked sheets S. Said inner plate 2 is rendered vertically rotatable with respect to the main body 1, about end shafts 3 and is biased upwards by a coil spring 5. Said spring 5 is positioned at a side of the front end of the inner plate 2, corresponding to a sheet supplying roller provided in the main body of the image forming apparatus.

Also in the cassette main body 1, at the upstream and downstream sides of a lateral face along the sheet supplying direction, there are formed reference guide members 6, 7 for one-side sheet supplying, for impinging on a lateral side, along the sheet supplying direction, of the sheets S stacked in said cassette main body 1. Conventionally, the reference guide member 7 at the downstream side is provided at the same reference position as that of the reference guide member 6 at the upstream side, as shown in FIG. 20.

Also in the cassette main body 1, at the other lateral side, along the sheet supplying direction, there is provided a side defining spring (plate spring) 9 for pressing a lateral side, along the sheet supplying direction, of the stacked sheets S toward the cassette reference guide members 6, 7. On both sides of a rear lateral plate 10 of the cassette main body 1, there are provided rear impinging portions 10A, 10B for impinging on the rear end of the sheets S stacked in the cassette main body 1. Also in the vicinity of the front end of the inner plate 2 in the cassette main body 1, there is provided a separating finger 11, only at the side of the coil spring 5, for individually separating the sheets S stacked in the cassette main body 1.

The sheets S are loaded in stacked state in the following manner, into the cassette main body 1 of the above-explained structure.

At first the rear end of a sheet stack is made to impinge on the rear impinging portions 10A, 10B. Then the front end of said sheet stack is inserted between the inner plate 2 and the separating finger 11, with the depression of said inner plate 2. Then a lateral side, along the sheet supplying direction, of the sheet stack placed on the inner plate 2 is pressed toward the cassette guide members 6, 7 (FIG. 21 shows a state of the sheet stack loaded in the cassette main body 1 in this manner). The lateral side 12, along the sheet supplying direction, of the sheets S stacked in the cassette main body 1 is pressed toward the cassette reference guide members 6, 7 by the biasing force of the side defining spring 9.

Said stacked sheets S are advanced by a sheet supplying roller 13 of the main body of the image forming apparatus, rotating in contact with the top of said stack, and are separated one by one by said separating finger 11 and fed to the image forming unit.

Such use of a sheet supplying roller and a separating finger deviated to a side aims at reducing the number of component parts and providing a less expensive apparatus.

However, such conventional sheet supplying cassette may result in a skewed supply of the sheet S in the course of supply by the roller 13, as will be explained in the following in relation to FIGS. 22A to 22D.

When the sheet S is given a transporting force by the roller 13, a portion a of the sheet S precedes and a portion b is delayed by a resistance in transportation (FIG. 22A). With the progress of transportation of the sheet S, there is generated a bend around a portion d of the sheet S (FIG. 22B). With further progress of the sheet transportation, there is generated a situation where the sheet S is in contact with the cassette reference guide member 6 of the upstream side but not with the guide member 7 of the downstream side (FIG. 22C). In this state the bend around the portion d disappears, but the front end of the sheet S becomes inclined by t, with respect to the reference position. If the sheet S is advanced in this state, it is supplied in a skewed state from the cassette main body 1.

As a result, the toner image is transferred in an inclined position onto the sheet S, so that the precision of printing is deteriorated.

SUMMARY OF THE INVENTION

An object of the present invention is to provide a sheet supplying device which can prevent skewed advancement in the supplied sheet.

The above-mentioned object can be attained, according to the present invention, by a sheet supplying device comprising:

sheet support means for supporting sheets;

sheet supply means for supplying sheets supported by said sheet support means, provided in a laterally deviated position with respect to the sheet supplying direction; and a stacking reference guide member for impinging on a lateral end of the sheets supported by said sheet support means thereby defining the position of said sheet, said guide member being adapted to define the position of the sheets supported by said sheet support means in such a manner that said sheets are supported in a state inclined by a predetermined angle with respect to the sheet supplying direction.

The sheet is rotated at the sheet advancement from the sheet supplying means provided at said laterally deviated position, and the inclination angle of the sheets supported by the sheet support means is so selected that a lateral end of thus rotated sheet is corrected and becomes parallel to the sheet supplying direction.

In such configuration, the skewed supply of the sheet caused by the sheet rotation at the advancement from the sheet supplying means in a laterally deviated position is compensated by supporting the sheets in advance in an inclined position, whereby the sheet can be supplied in a straight position, without skewed advancement.

Another object of the present invention is to provide a sheet supplying device capable of transporting the sheet without skewed advancement.

The above-mentioned object can be attained, according to the present invention, by a sheet supplying device comprising:

sheet support means for supporting sheets;

sheet supply means for supplying sheets supported by said sheet support means, provided in a laterally deviated position with respect to the sheet supplying direction;

plural stacking reference guide members provided along the sheet supplying direction, for impinging on a lateral end of the sheets supported by said sheet support means thereby defining the position of said sheets, said guide members being adapted to define the position of the sheets supported by said sheet support means in such a manner that said sheets are supported in a state inclined by a predetermined angle with respect to the sheet supplying direction;

skewed transport means for transporting a sheet, advanced by said sheet supply means, in impingement on a transport reference guide member provided in a main body of the device; and engagement means for engaging with the most downstream one of said stacking reference guide members and with the transport reference guide member thereby maintaining said guide members in a same plane.

In this configuration, the skewed advancement of the sheet caused by the sheet rotation is compensated by supporting the sheets in advance in an inclined position by the stacking reference guide members, whereby the sheet is advanced in straight manner. Then the sheet is transported along the transport reference guide member positioned on a same plane as the stacking reference guide member at the downstream side, whereby the sheet is always transported along a same plane. Thus the precision of sheet transportation can be improved, without the skewed sheet supply.

In this manner the present invention improves the condition of the transported sheet, thereby enabling to effect processes such as image formation, printing and image reading with a high precision.

DETAILED DESCRIPTION OF THE PREFERRED EMBODIMENTS

Now the present invention will be clarified in detail by preferred embodiments thereof shown in the attached drawings.

Figure 1:
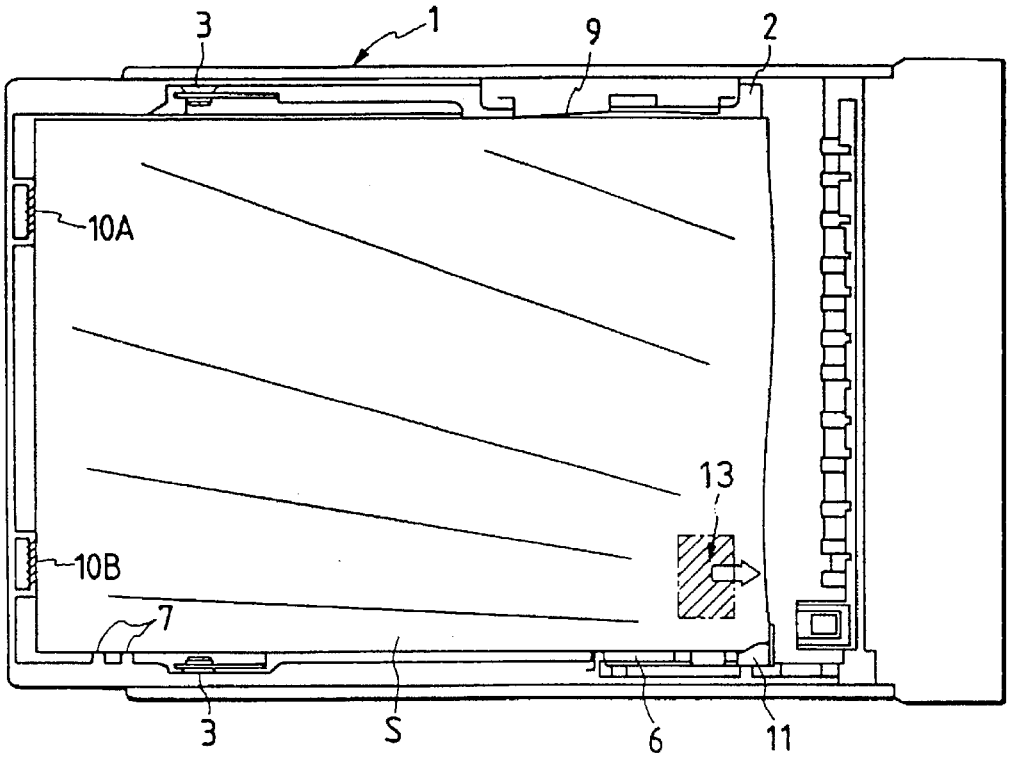
FIG. 1 is a plan view of a sheet supplying cassette constituting a first embodiment of the present invention.

FIG. 1 illustrates a sheet supplying cassette constituting a first embodiment of the present invention, wherein components same as those in the conventional sheet supplying cassette explained above are represented by same symbols, and such components equivalent in structure and function will not be explained further in the following description.

Figure 2:
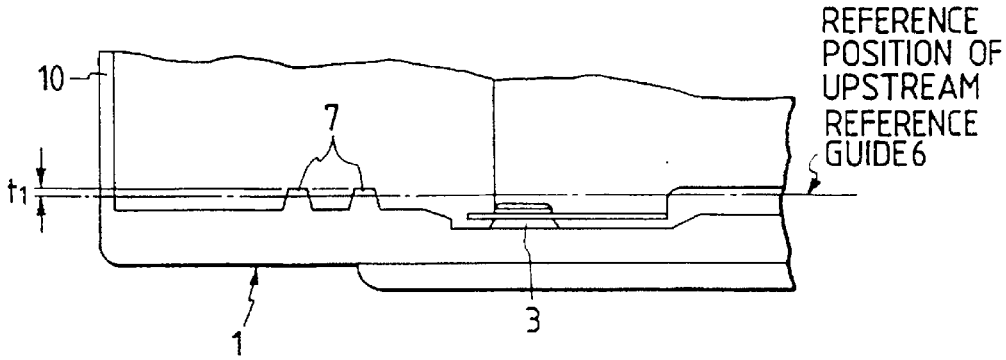
FIG. 2 is a detailed view of a cassette reference guide member shown in FIG. 1.

In this cassette, as shown in FIG. 2, the cassette reference guide members 7 at the upstream side protrude more, toward the center of the cassette main body 1, than the cassette reference guide member 6 at the downstream side. In the illustrated case, the guide members 7 protrude more, by an amount t1, than the guide member 6. Consequently the stacked sheets S in the main body 1 are inclined, as shown in FIG. 1, with respect to the sheet supplying direction.

Now reference is made to FIGS. 3A to 3D for explaining the supply process of the sheets S, stacked in the present cassette, by the sheet supplying roller 13.

Figure 3A:
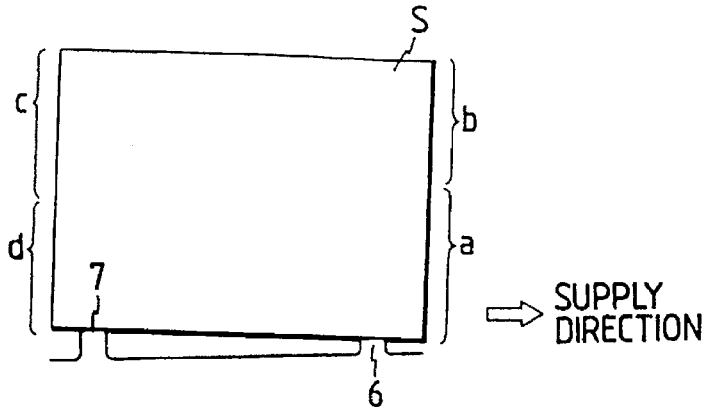
FIGS. 3A to 3D are views showing the correction of sheet position by a mechanism shown in FIG. 1.
Figure 3B:
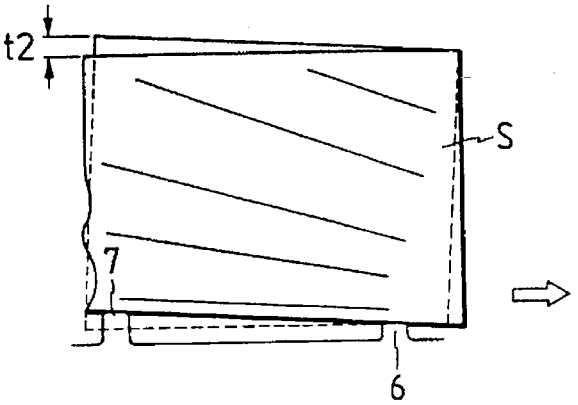

When the sheet S is given a transporting force by the roller 13, a portion a of the sheet S precedes in the transportation. However, since the sheet S is in advance in an inclined position (FIG. 3A), the portions a and b, constituting the front end of the sheet S become perpendicular to the reference position, when the sheet supply is started (FIG. 3B). In this state, the rear end of the sheet S is pressed toward the cassette reference guide member 7 at the upstream side, thereby generating a bend around a portion d of the sheet S and also generating a positional aberration of an amount t2in a portion c of the sheet S. Said amount t2of aberration is approximately same as the amount t1of protrusion of the cassette reference guide member 7 at the upstream side.

Figure 3C:
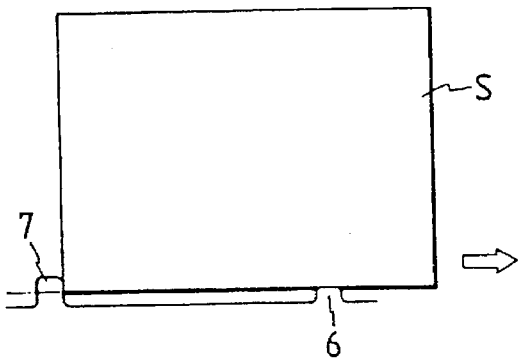
Figure 3D:
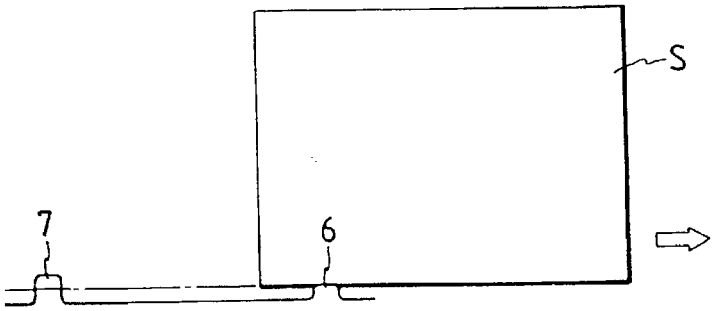

As the sheet S proceeds further and is separated from the separating finger 11 and the cassette reference guide member 7 of the upstream side, the portion c of the sheet S is not displaced but the bend in the portion d disappears (FIG. 3C). In this state the sheet S is no longer inclined, and it leaves the cassette main body 1 without the inclination (FIG. 3D).

Figure 4:
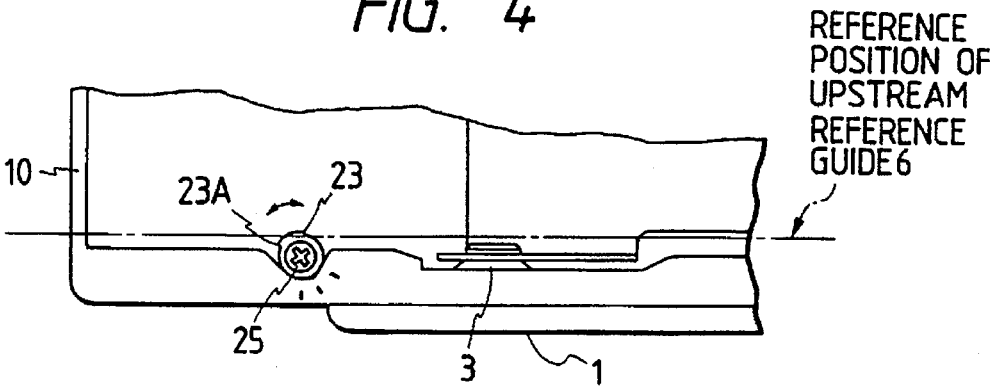
FIG. 4 is a partial plan view of a 2nd embodiment of the present invention.

FIG. 4 is a partial view of a sheet supplying cassette constituting a 2nd embodiment of the present invention. In this embodiment, the portion of the cassette omitted from FIG. 2 is constructed same as in the conventional sheet supplying cassette explained before.

In this embodiment, the cassette reference guide member 23 at the upstream side is composed of an eccentric cam, of which amount of protrusion can be varied in sevaral levels by a click mechanism. Such cassette reference guide member 23 allows to vary the amount of protrusion, according to the kind of the sheet S to be employed. For example, a resilient sheet S shows a smaller bend at the rear end when the transporting force of the supplying roller 13 is applied, so that said guide member 23 is made to protrude only slightly from the refernece position of the cassette reference guide member 6 at the downstream side. On the other hand, a non-resilient sheet S shows a larger bend at the rear end, so that the cassette reference guide member 23 at the upstream side is set at a position more separate from the reference position of the guide member 6 at the downstream side.

The guide member 23 at the upstream side can be rotated as indicated by an arrow, by loosening a central screw 25. The amount of protrusion is varied by such rotation, and said guide member 23 is fixed in position by tightening said central screw 25. Said guide member 23 at the upstream side is provided with a stopper 23A, in order to prevent that it becomes positioned outside the reference position of the reference guide member 6 at the downstream side by an excessive rotation.

Figure 5:
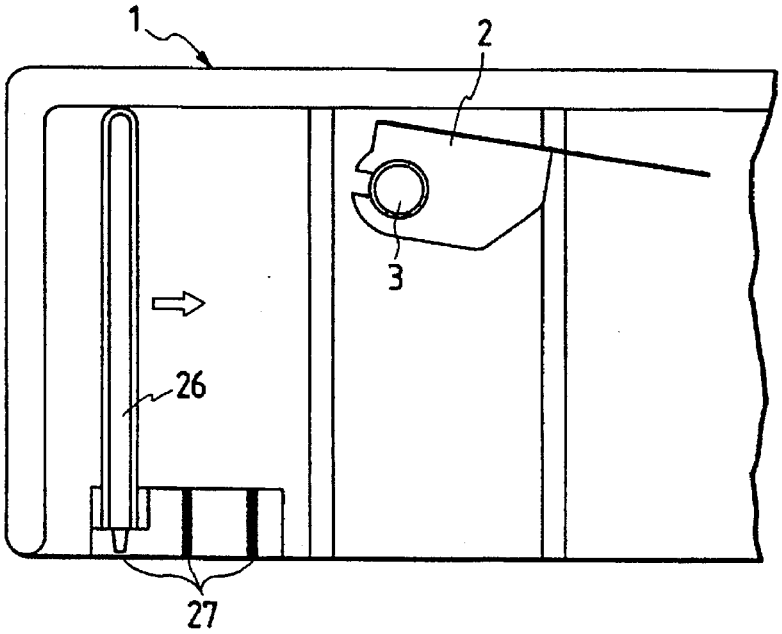
FIG. 5 is a partial lateral view of a 3rd embodiment of the present invention.
Figure 6:
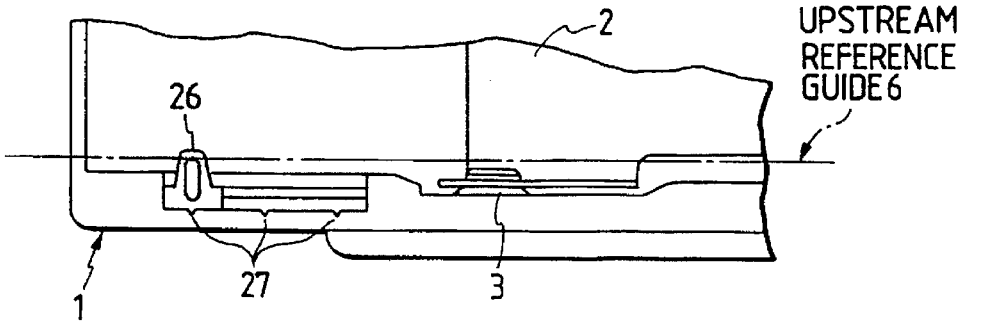
FIG. 6 is a partial plan view of the embodiment shown in FIG. 5.

FIGS. 5 and 6 are partial views of a sheet supplying cassette constituting a 3rd embodiment of the present invention, wherein the portion omitted from FIGS. 5 and 6 is constructed same as in the conventional cassette explained before.

In the present embodiment, the cassette reference guide member 26 at the upstream side is rendered movable within a predetermined range, and such movement varies the position or inclination of the sheets S stacked in the cassette main body 1.

Said guide member 26 can be set in one of several clock grooves 27 positioned along the sheet supplying direction, and the setting position is varied according to the kind of the sheet S to be employed.

Figure 7:
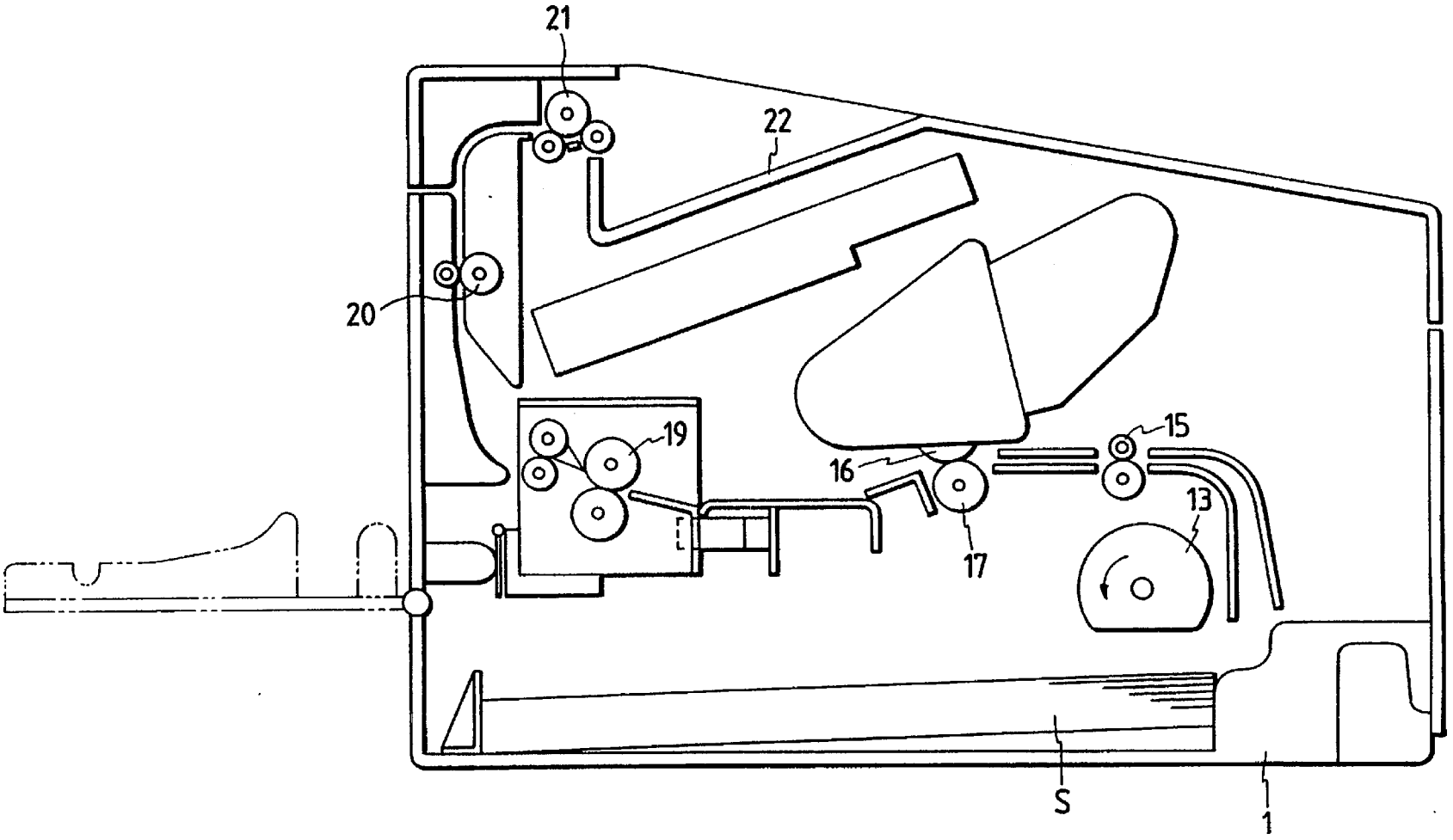
FIG. 7 is a longitudinal cross-sectional view of an image forming apparatus in which loaded is the sheet supplying cassette shown in FIG. 1.

In the following there will be given a brief explanation, with reference to FIG. 7, on a laser beam printer (image forming apparatus), in which the above-explained sheet supplying cassette is loaded.

A semicircular sheet supplying roller 13, when rotated anticlockwise, gives a frictional force to the top of the sheet stack in the cassette main body 1, whereby the uppermost sheet is separated by the separating finger 11 and advanced. In this operation, the roller 13 comes into pressure contact with said uppermost sheet.

The sheet S advanced by the roller 13 is guided by the reference guide members 6, 7 of the cassette main body 1 to paired registration rollers 15. Subsequently, the sheet S is advanced to the nip between a photosensitive drum 16 and a transfer roller 17, where a toner image is transferred from said photosensitive drum 16.

The sheet S bearing the toner image thereon is transported to paired fixing rollers 19, where it is subjected to the fixation of the toner image. After said toner image fixation, the sheet S is discharged onto a tray 22 through lower paired discharge rollers 20 and upper paired discharge rollers 21.

In the following, there will be explained the relationship between the cassette reference guide member 6 of the sheet supplying cassette and a transport reference guide member provided in the main body of the image forming apparatus, with reference to FIG. 10 which is a developed view of the sheet transport system from the cassette.

Said transport system is composed of driving roller 30 of a frictional member; an idler roller 31 in pressure contact therewith; cassette reference guide members 6, 7 and a transport reference guide member 32 constituting impingement guides; sheet supply unit driving rollers 33 of frictional members positioned immediately in front of the image transfer unit; and idler rollers 34. The driving roller 30, the driving rollers 33 and the idler rollers 34 mentioned above are mounted on reference plate 32, while the idler roller 31 is mounted on the cassette main body 1.

Figure 10:
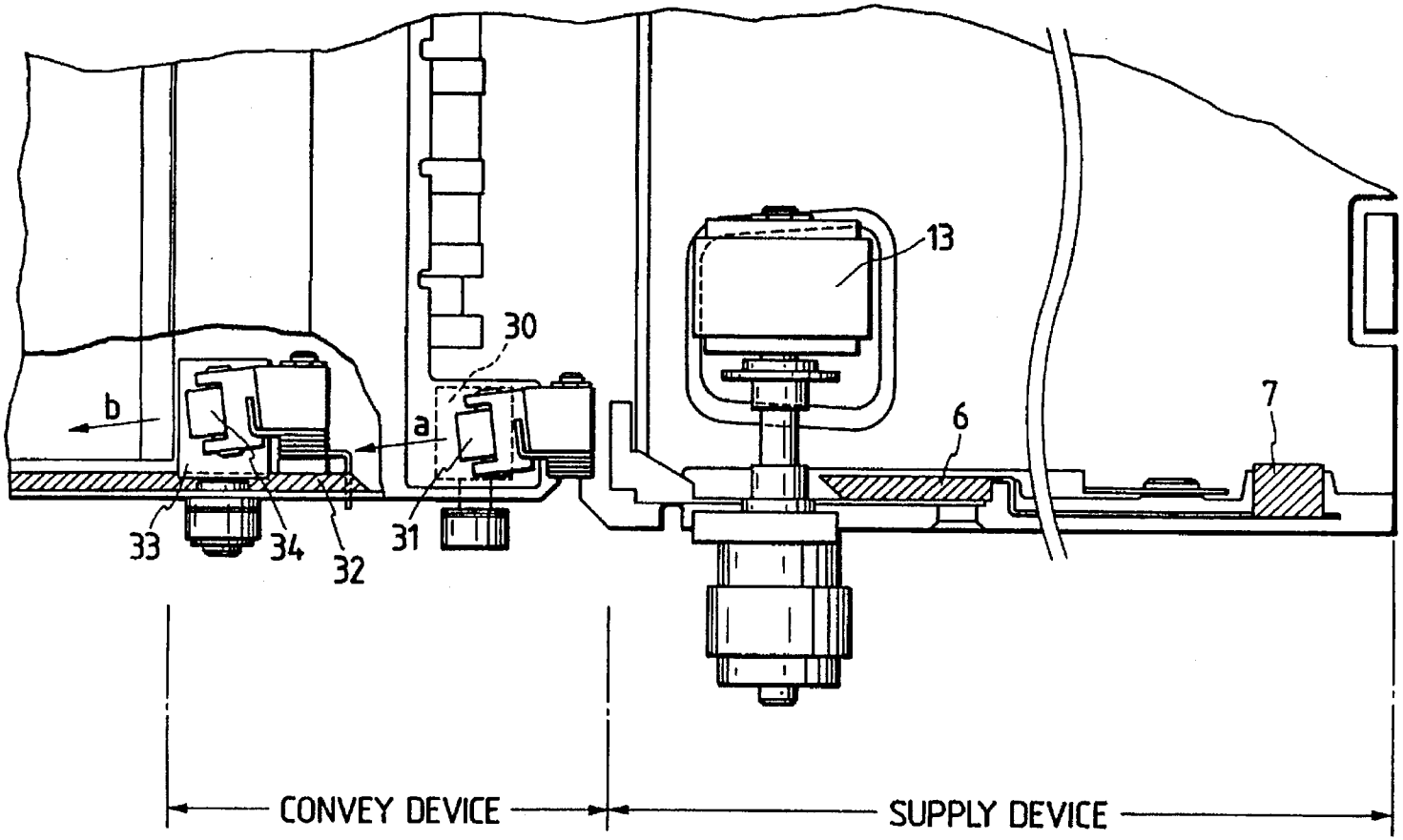
FIG. 10 is a developed view of a transport system of the apparatus shown in FIG. 8.

The driving roller 30, the idler roller 31, the sheet supply unit driving roller 33 and the idler roller 34 are respectively in twisted positions, whereby the driving roller 30 and the idler roller 31 advance the sheet in a direction toward the cassette reference guide members 6, 7 (direction a in FIG. 10), while the sheet supply unit driving roller 33 and the idler roller 34 advance the sheet toward the transport reference guide member 32 (direction b in FIG. 10). Thus, the sheet S is transported in impingement with the cassette reference guide members 6, 7 and the transport reference guide member 32.

Figure 11:
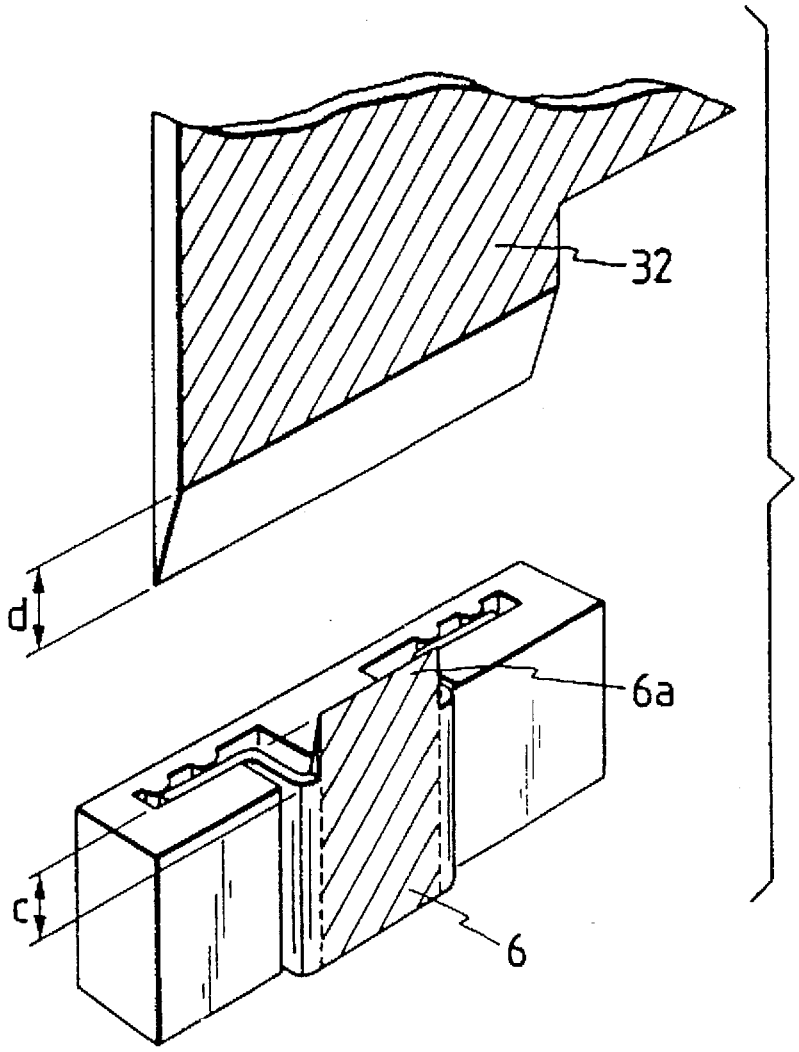
FIG. 11 is a perspective view showing the engaging relationship between the cassette reference guide member and the transport reference guide member.

The cassette main body 1 is pressed by a lateral spring 35 toward the transport reference guide member 32. Also as shown in FIG. 11, the cassette reference guide member 6 at the downstream side is provided with a protrusion **6*a* of a length c toward the transport reference guide member 32, and said protrusion 6*a* is shaped diagonally in the vertical direction. On the other hand, the transport reference guide member 32 is shaped diagonally for a length d so as to engage with the guide member 6 of the downstream side, wherein c is equal to d. With this configuration, when the sheet supplying cassette is mounted, the hatched portion of the guide member 6, shown in FIG. 11, and the hatched portion of the guide member 32** lie on a same plane.

Consequently, the sheet S advanced from the cassette main body 1 is transported always in contact with the cassette reference guide member 6 or the transport reference guide member 32. Since said guide members 6, 32 mutually engage and lie on a same plane, the sheet S reaches the image transfer position, always maintaining a perpendicular position to the reference position, both in the cassette main body 1 and in the sheet transport system.

In the above-explained embodiment shown in FIG. 11, the protrusion **6*a* of the cassette reference guide member 6 and the transport reference guide member 32 are both inclined and are in mutual contact by the lateral spring 35. Said lateral spring 35 is dispensed with in an embodiment shown in FIG. 12, wherein the cassette reference guide member 6 is provided with a protrusion 6*a* of a length c same as in the foregoing embodiment, said protrusion being formed in an inclined shape. The transport reference guide member 32 is provided with a folded portion 32*a***, on a side opposite to the sheet S.

Figure 8:
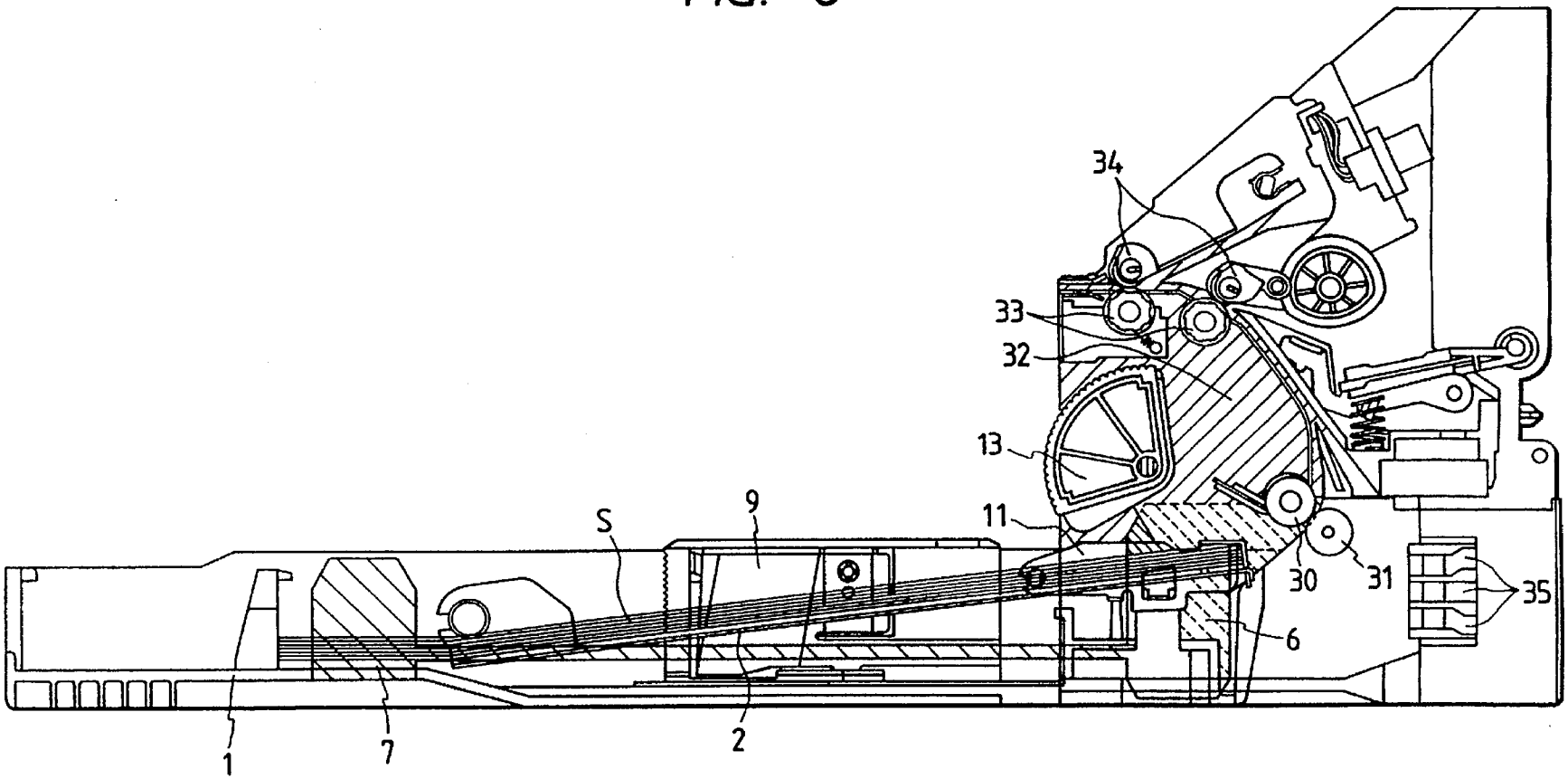
FIG. 8 is a longitudinal cross-sectional view of an image forming apparatus of the present invention showing the relationship between the cassette reference guide members of the sheet supplying cassette and the transport reference guide member in the main body of the apparatus.
Figure 9:
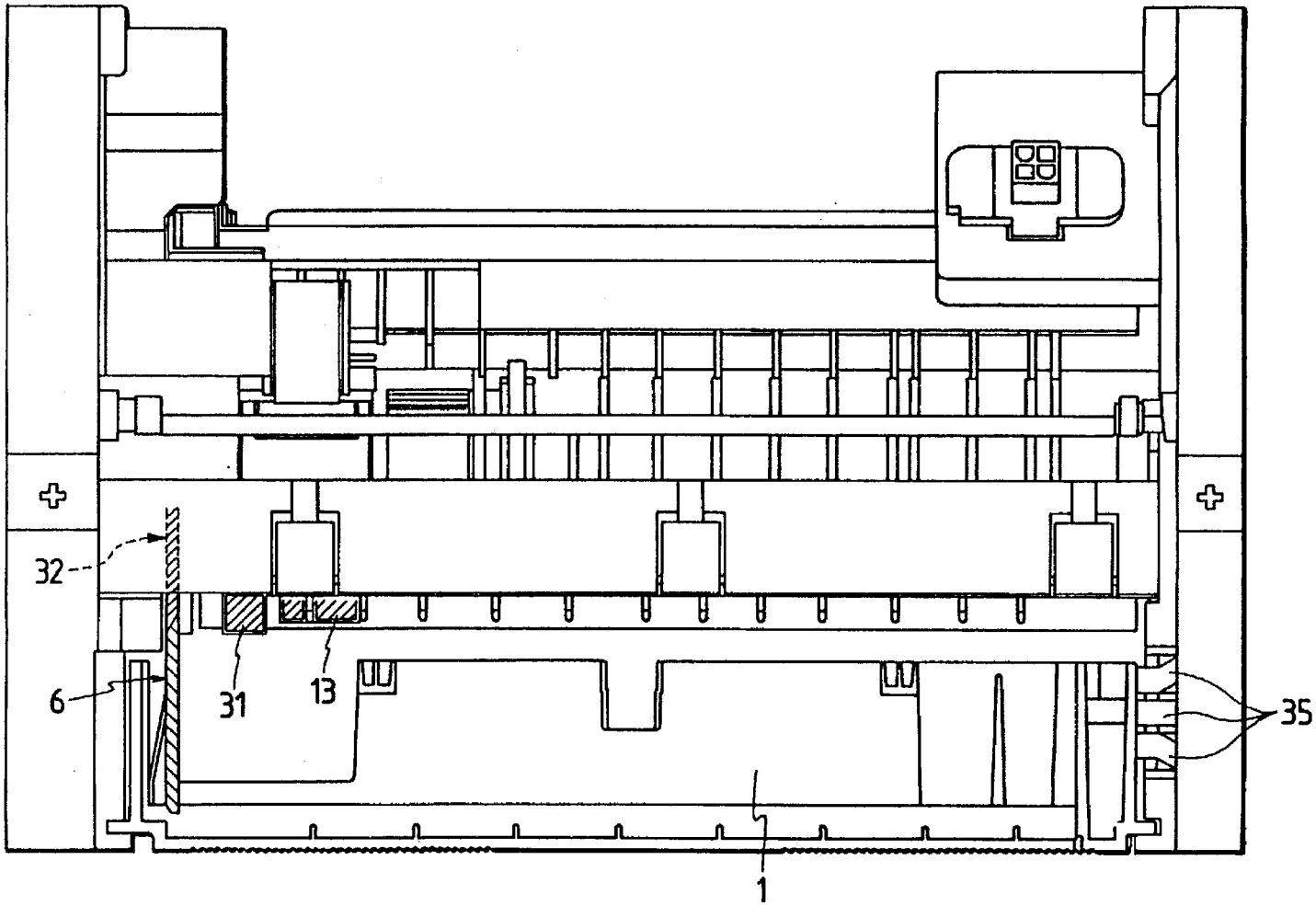
FIG. 9 is a lateral view, seen from the right-hand side, of the apparatus shown in FIG. 8.

Such folded portion **32*a* provided on the transport reference guide member 32 for cooperating with the cassette reference guide member 6 not only places the guide members 32, 6 on a same plane but also dispenses with the lateral spring 35 shown in FIG. 8**, thereby enabling a reduction in the cost.

Figure 12:
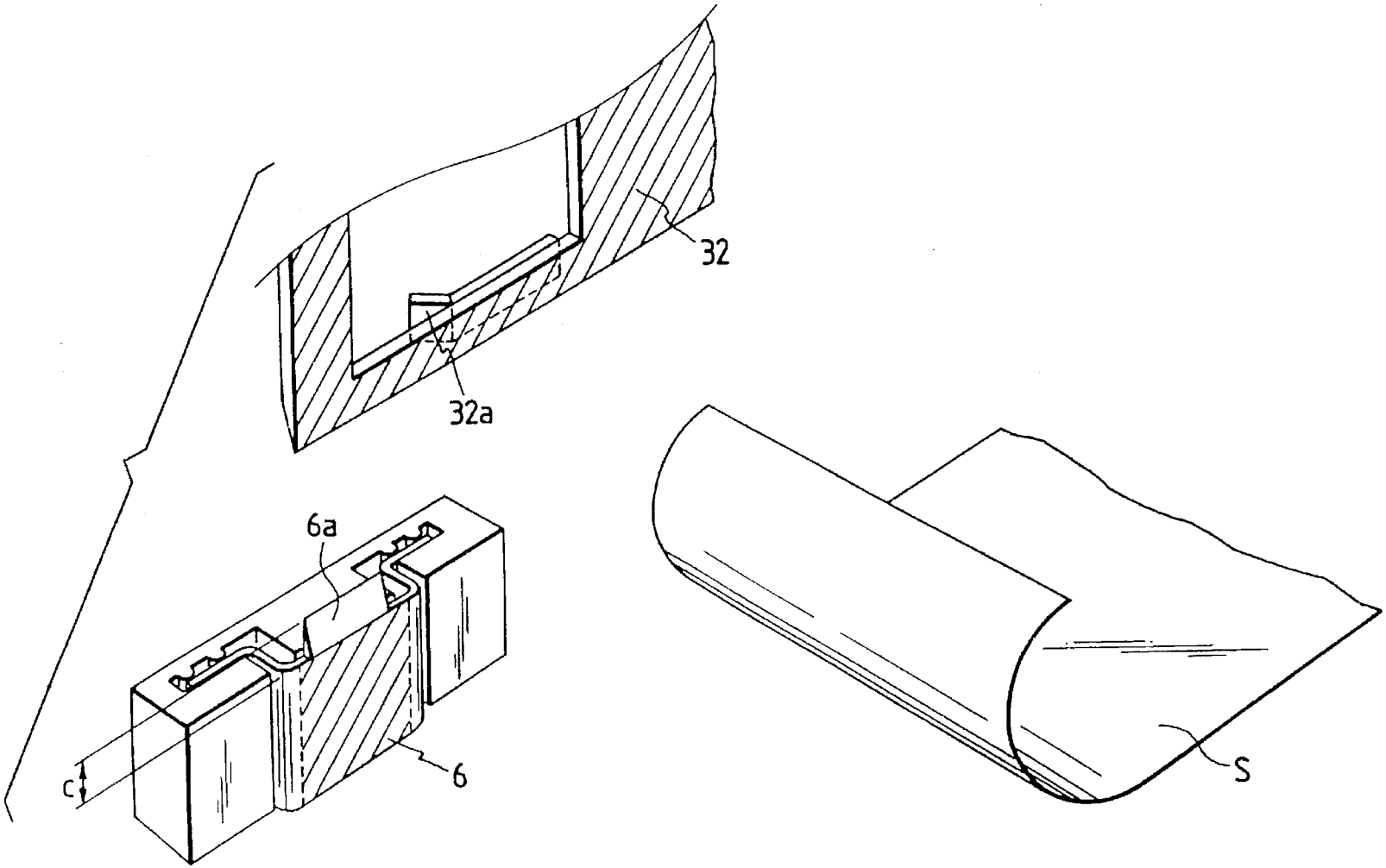
FIGS. 12 to 14 are perspective views showing other examples of the engaging relationship between the cassette reference guide member and the transport reference guide member.

In the above-explained embodiments shown in FIGS. 11 and 12, in which the cassette reference guide member 6 is provided with a protrusion 6*a*, said guide member 6 is generally composed of a metal, because it can be abraded by constant contact with the sheets.

Also said protrusion 6*a* of the guide member 6, as shown in FIGS. 11 and 12, is easily deformed, as it has an inclined shape.

Figure 14:
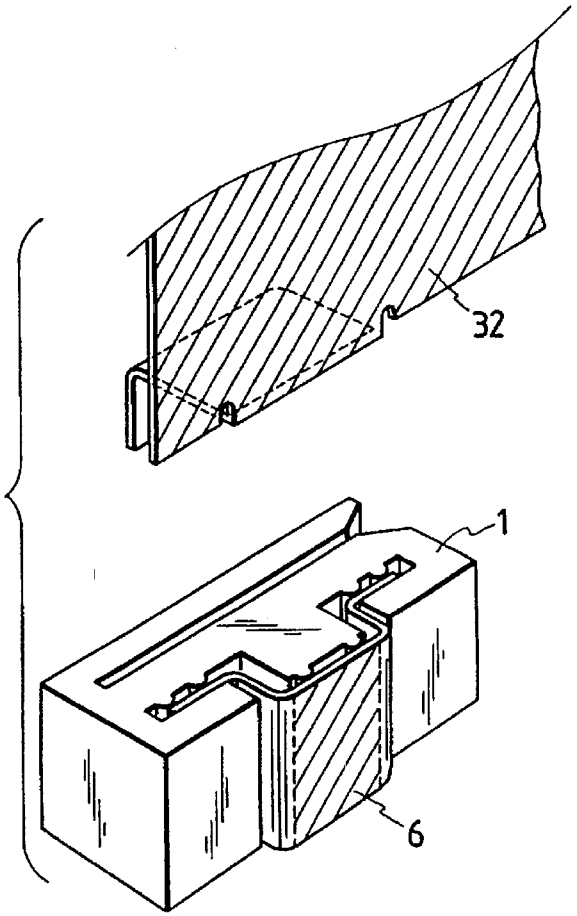
Figure 13:
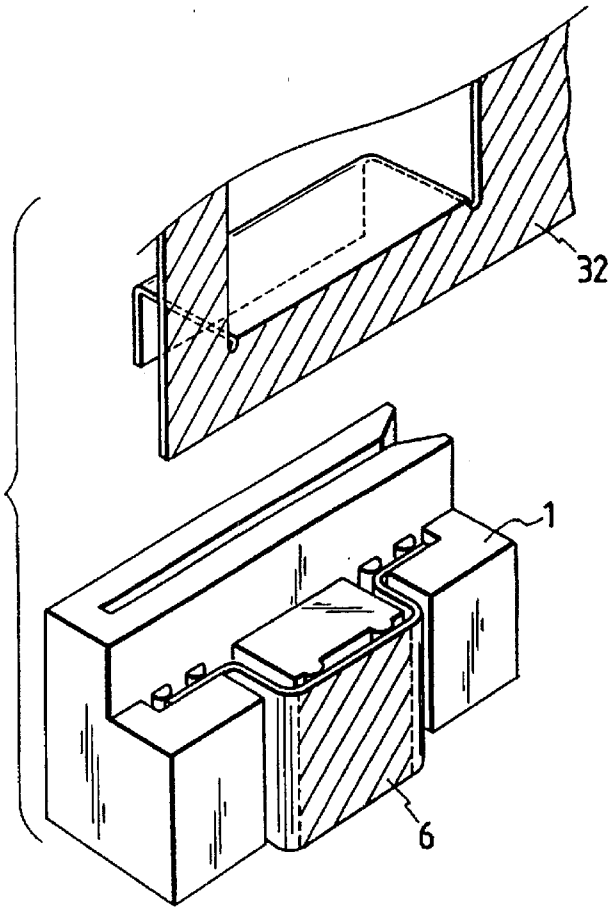

FIGS. 13 and 14 show other embodiments for resolving the above-mentioned drawback, wherein the transport reference guide member 32 and the cassette reference guide member 6 are given a same function by the addition of a component part, which is provided in the cassette main body 1. In this case the insertion slot is formed in the cassette main body 1, whereby improved durability can be provided.

As explained in the foregoing, the reference guide member of the sheet supplying cassette or that of the transport system is provided with a protrusion for engaging with the other guide member, or the reference plate member, constituting a reference for the sheet transportation, thereby improving the state of sheet in transportation and also improving the precision of printing.

Figure 15:
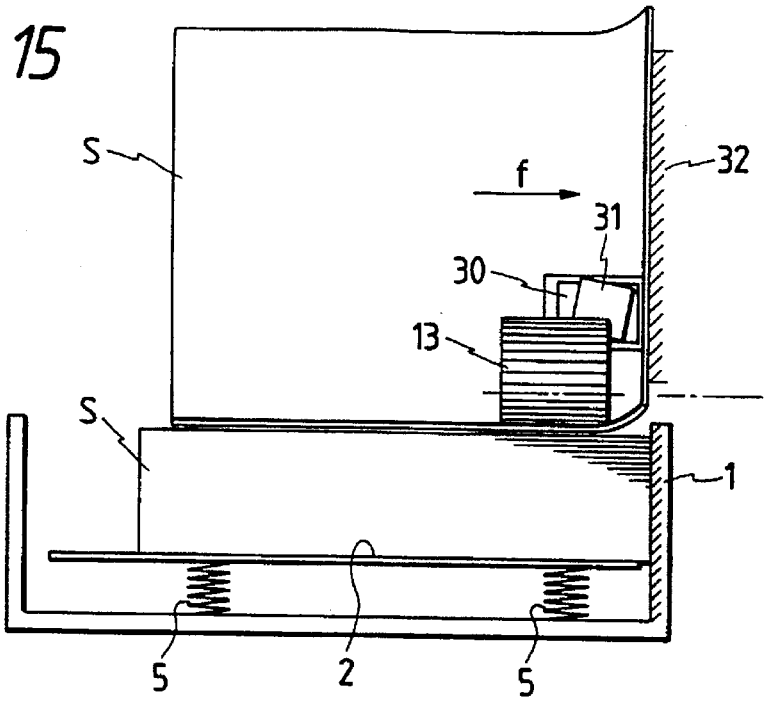
FIG. 15 is a view of the sheet supplying device of the present invention, seen along the sheet supplying direction.

In the above-explained sheet supplying device, when the sheet S after separation is subjected to the correction of the lateral positional aberration by the driving roller 30 and the idler roller 31, the rear portion of the sheet S is pressed to the cassette reference guide member by the force f applied by said idler roller 31, as shown in FIG. 15. Thus, if the sheet S is resilient and thin, it is easily bent and may eventually rise across the lateral wall of the cassette main body 1. In the following, there will be explained another embodiment for resolving the above-mentioned drawback. The sheet supplying device may be detachably mounted in the lower part of a laser beam printer.

Figure 16:
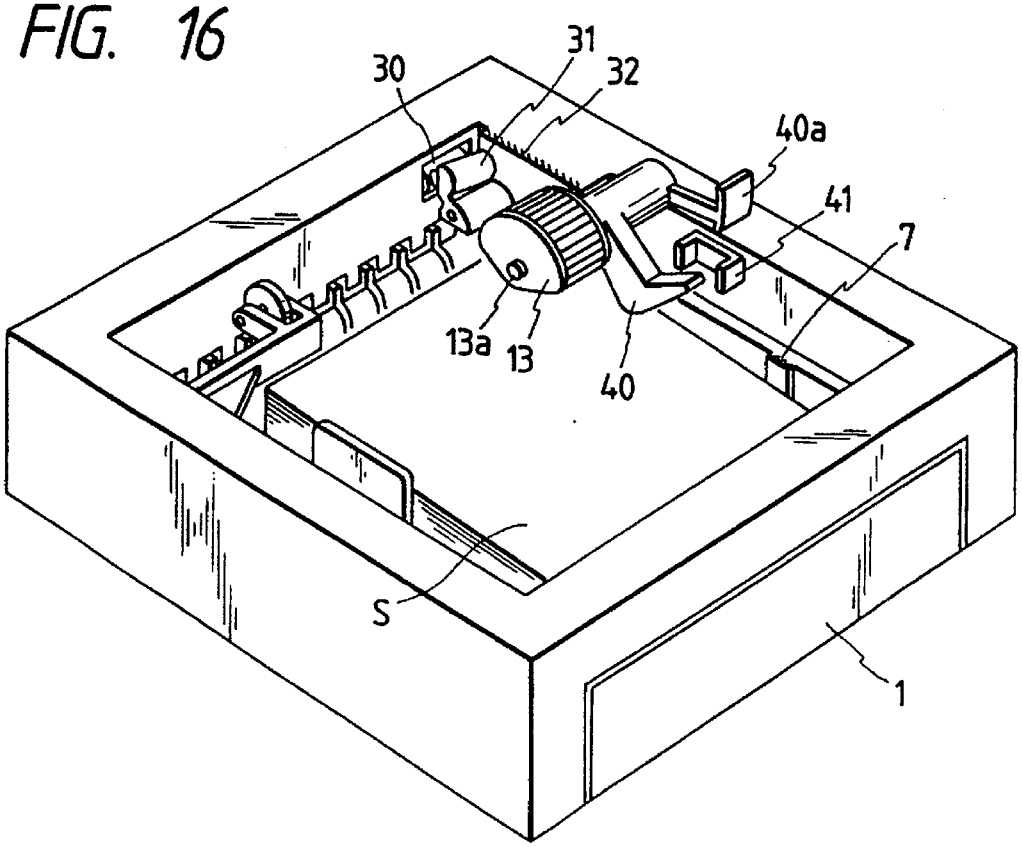
FIG. 16 is a perspective view of the sheet supplying device of the present invention.
Figure 17:
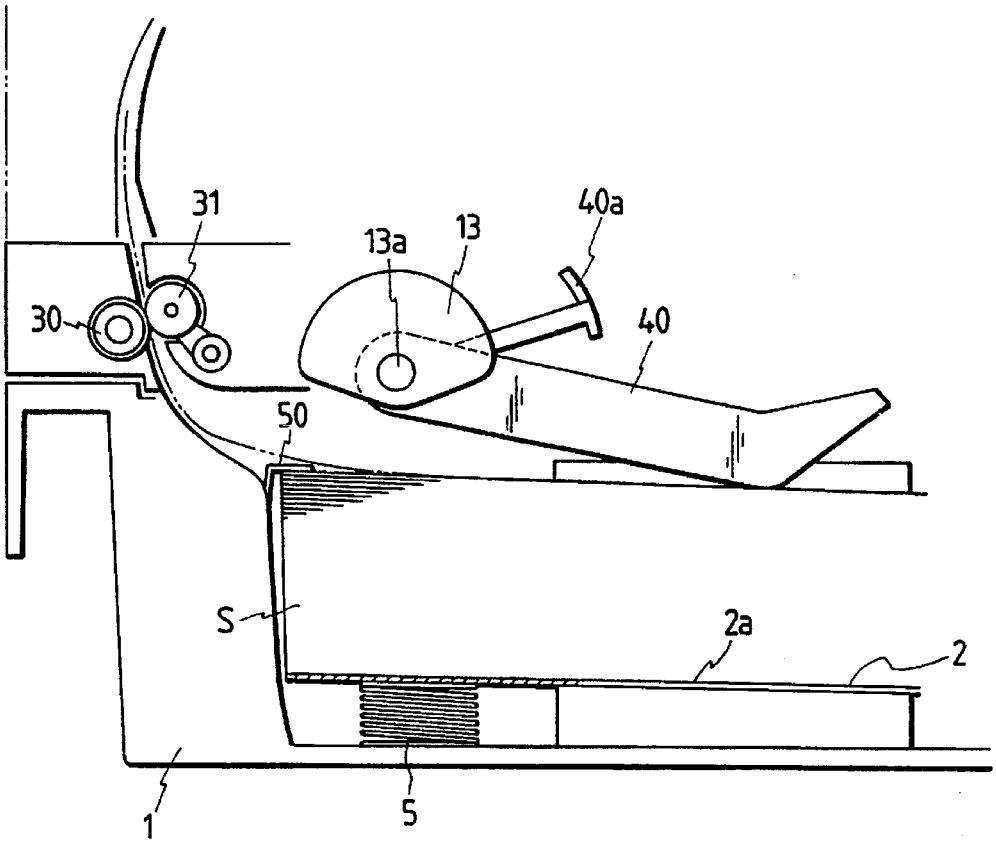
FIG. 17 is a partial longitudinal cross-sectional view showing means for preventing the riding across of the sheet in the sheet supplying device shown in FIG. 16.

Referring to FIGS. 16 and 17, above and close to the cassette reference guide member 6, there is rotatably provided a biasing member 40, serving also as a sheet detecting member and rendered rotatable about a shaft 13*a* of the sheet supplying roller 13. Said biasing member 40 is maintained in contact with the uppermost sheet S and biases sheets S toward the inner plate 2. Said biasing member 40 is provided with a shield plate 40*a* for interrupting the light of a photosensor 41.

In the absence of the sheet S, said biasing member 40 enters a hole 2*a* provided in the inner plate 2, thus making a larger rotation than in the case of presence of the sheet S. Said photosensor 41 is provided in a position corresponding to such larger rotation, whereby the presence or absence of the sheet S can be detected by the shield plate 40*a*. When the sheet supplying roller 13 is driven by a turn in the sheet supplying direction, the periphery of said roller, contacting the uppermost sheet, provides an advancing force by friction in the supply direction, whereby the uppermost sheet S forms a loop in the vicinity of the separating finger 11, and is thus separated and advanced.

Then, by the function of the driving roller 30 positioned at the downstream side and the idler roller 31 for advancing the sheet in a diagonally front direction, a lateral edge, along the sheet supplying direction, of the sheet S impinges on the transport reference guide member 32 whereby the lateral positional aberration is corrected. In this state, the sheet S in transportation is pressed toward the cassette reference guide members 6, 7 by the idler roller 31 and is thus bent, causing a movement to ride across said guide members 6, 7. However, since the biasing member 40, provided in the vicinity of the cassette reference guide member 6, always biases the sheet S in transportation toward the inner plate 2, the sheet S does not ride across the guide members 6, 7, thus prevented from significantly skewed supply.

Figure 18:
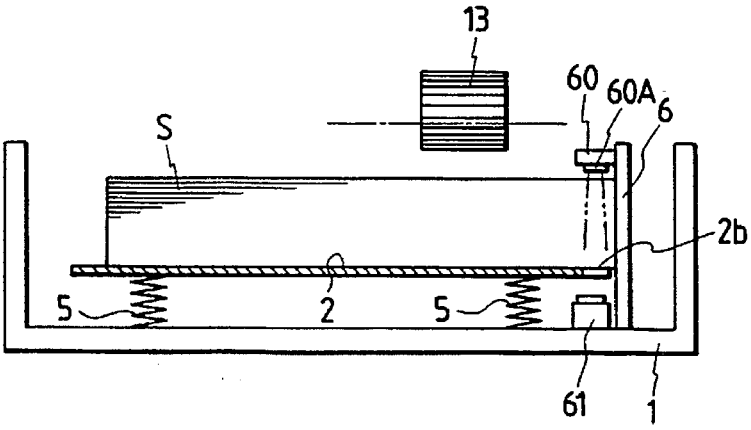
FIG. 18 is a cross-sectional view showing another example for preventing the sheet riding-across.
Figure 19:
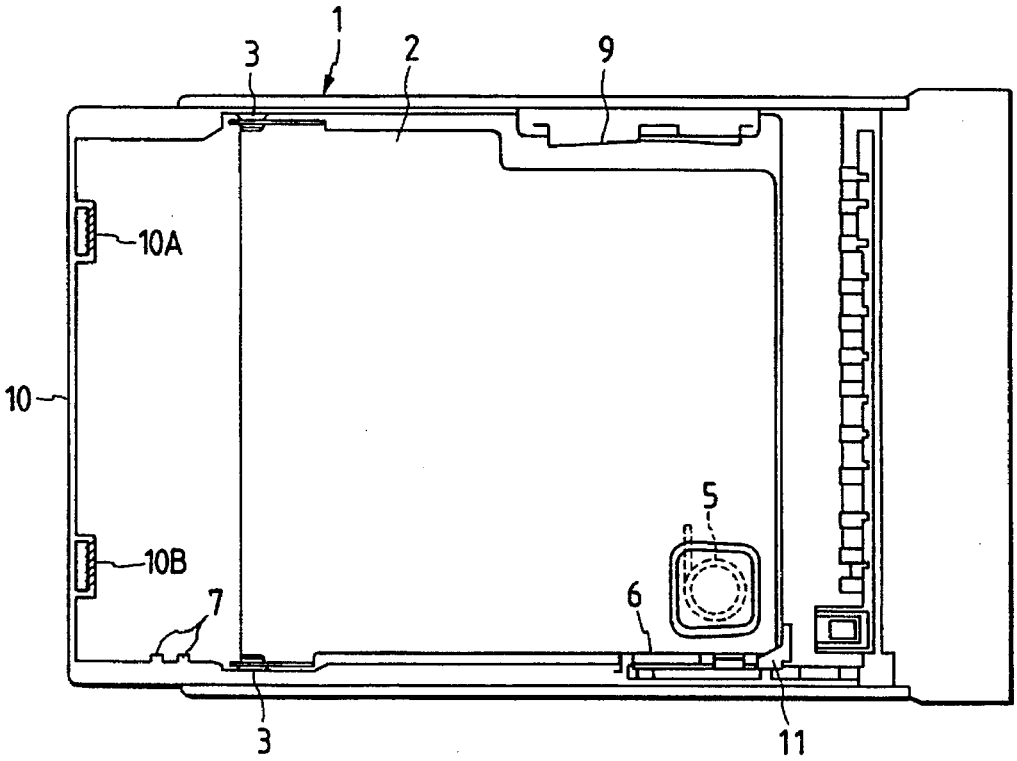
FIG. 19 PRIOR ART
FIG. 19 is a plan view of a conventional sheet supplying cassette.
Figure 20:
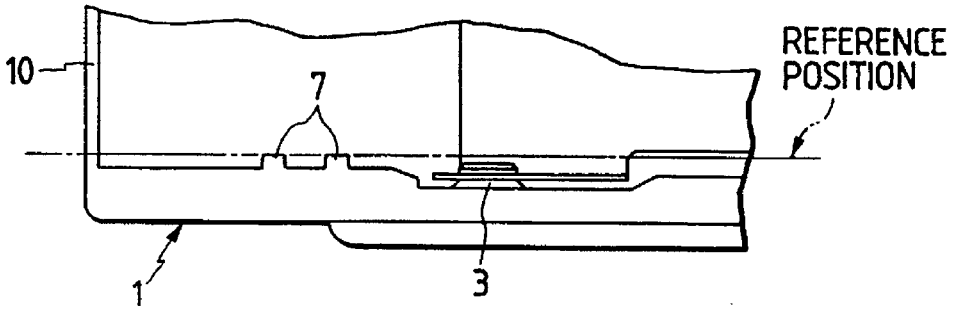
FIG. 20 PRIOR ART
FIG. 20 is a partial magnified view showing the details of the cassette reference guide members provided in the cassette shown in FIG. 19.
Figure 21:
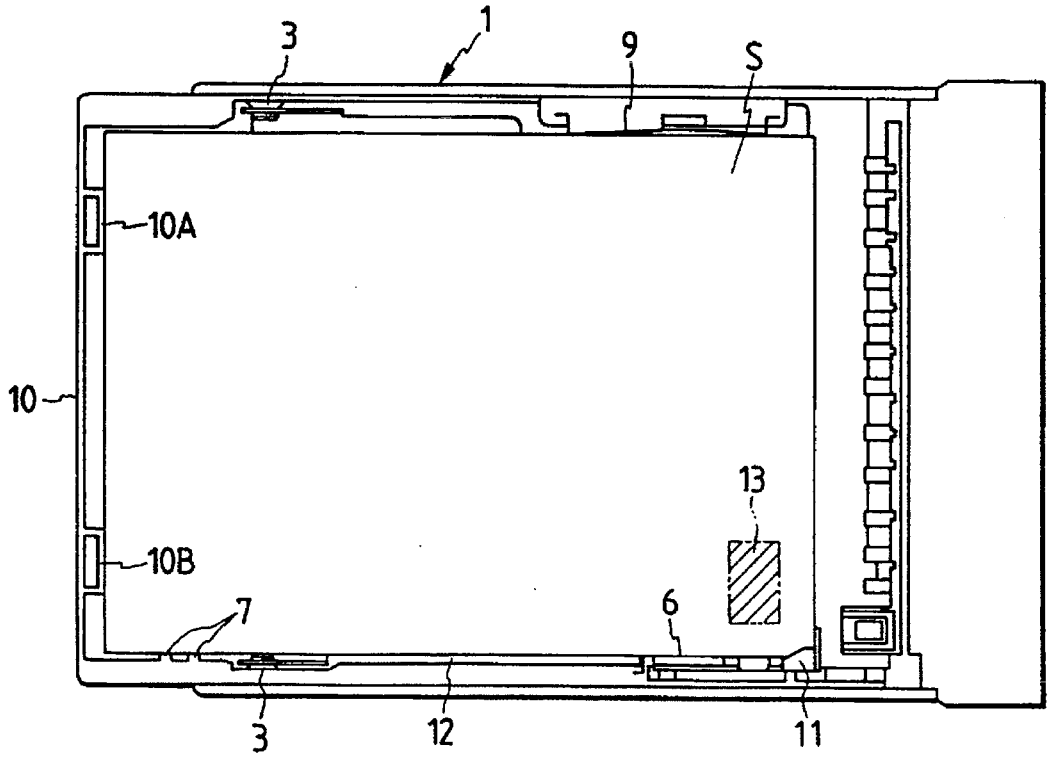
FIG. 21 PRIOR ART
FIG. 21 is a plan view showing a state in which sheets are stacked in the sheet supplying cassette shown in FIG. 19.
Figure 22A:
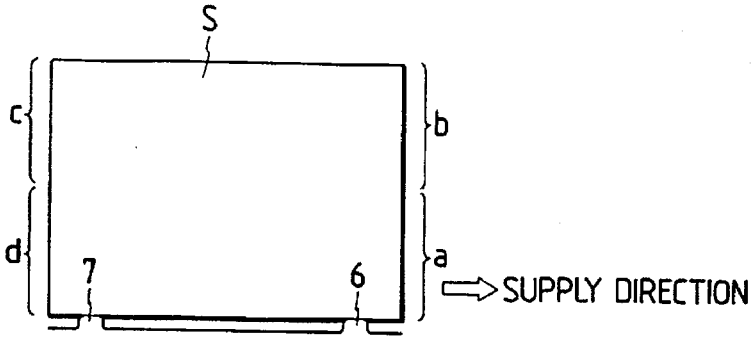
FIG. 22A PRIOR ART
FIGS. 22A to 22D are views showing the occurrence of the skewed advancement at the sheet supply in the conventional sheet supplying device.
Figure 22B:
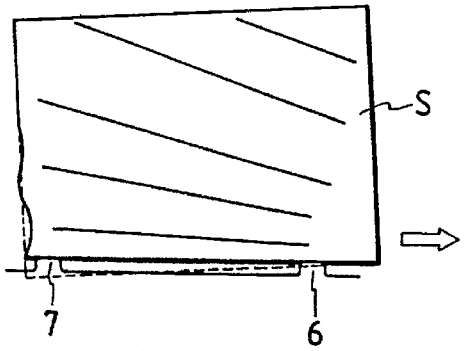
FIG. 22B PRIOR ART
Figure 22C:
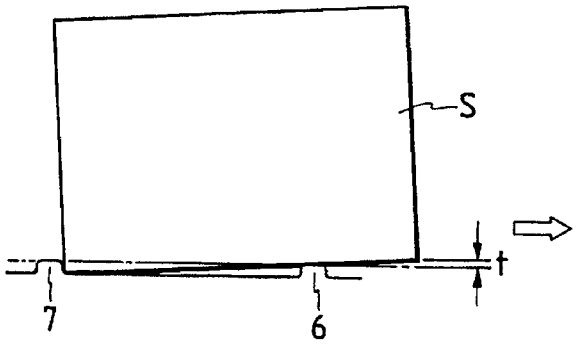
FIG. 22C PRIOR ART
Figure 22D:
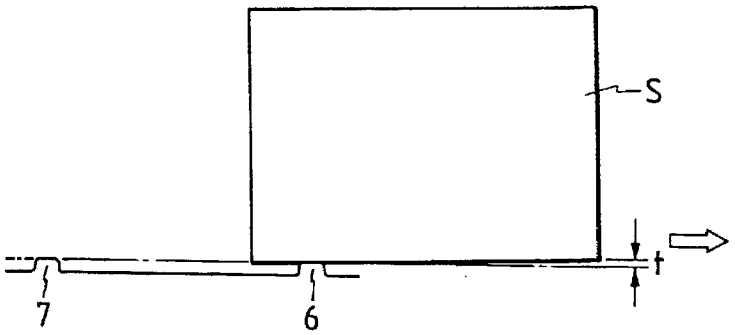
FIG. 22D PRIOR ART

FIG. 18 illustrates another embodiment in which a sheet detecting unit 60, having a light emitting element 60A, is provided in the vicinity of the cassette reference guide member 6 and in a position lower than the upper end of said guide member 6.

When the power supply is turned on, the light emitting element 60A of the sheet detecting unit 60 emits a light beam toward a photosensor element 61 provided in a position opposed to said light emitting element 60A. In the presence of the sheet S, the emitted light is intercepted by said sheet S, whereupon a signal indicating the presence of the sheet S is released, and the sheet supplying operation is re-activated.

In the absence of the sheet S, the emitted light enters the photosensor element 61 through a notch 2*b* provided in the inner plate 2, whereupon a signal indicating the absence of the sheet S is released and the sheet supplying operation is interrupted.

Even if the sheet S is bent and moves to ride across the cassette reference guide member 6, such movement is prevented because the sheet detecting unit 60 is provided in the vicinity of the cassette reference guide member 6 and in a position lower than the upper end of said guide member 6.

In the present embodiment, it is naturally possible also to form an outwardly extending portion on the side wall of the cassette main body 1 and mount the light emitting element on said extending portion.

The present invention is applicable not only to a sheet supplying device for a printer, but also to such device for supplying recording sheets or original documents to various image forming apparatuses or image reading apparatus such as a copying machine, a facsimile apparatus, a word processor or the like.

Also, the present invention is not limited by the foregoing embodiments but is subject to various modifications. For example, it is not limited to the form of a sheet supplying cassette detachably mounted on a main body of the apparatus but is also applicable to a configuration in which sheets are stacked on a tray and are supplied therefrom.

Also, the cassette reference guide members need not be provided at the side of the supplying means but may be provided at the opposite side. In more general terms, there may be employed any configuration capable of defining the sheets in advance in an inclined position, in order to correct the position of the sheet supplied by the supply means in a laterally deviated position.

What is claimed is:

1. A sheet supplying device, comprising:

sheet support means for supporting sheets;

sheet supply means, disposed at a position offset from a centerline of the sheets in a widthwise direction thereof, for supplying in a sheet supplying direction a sheet from the sheets supported by said sheet support means;

a plurality of reference guide members, arranged along the sheet supplying direction, for regulating one lateral end of the sheets supported by said sheet support means, said reference guide members defining the position of the sheets supported by said sheet support means in such a manner that said sheets are supported inclined at a predetermined angle with respect to the sheet supplying direction;

transport reference guide means for guiding one lateral end of the sheet supplied by said sheet supply means;

transport means for transporting the sheet supplied by said sheet supply means while urging the one lateral end of the sheet against the transport reference guide means; and engagement means for engaging with one of said reference guide members at its most down stream side and with said transport reference guide means to maintain a sheet regulating surface of said one reference guide member and a sheet guiding surface of said transport reference guide means in a same plane.

2. A device according to claim 1, wherein the inclination angle of said sheets is such as to rotate the sheet upon feed-out from the sheet supply means, whereby a lateral end of the thus rotated sheet becomes parallel to the sheet supplying direction.

3. A device according to claim 2, wherein said sheet support means includes a plate for supporting the sheets and a biasing member for biasing said plate toward the sheet supply means to bring the supported sheets into contact with the sheet supply means.

4. A device according to claim 3, wherein said plate and said biasing member are provided in a frame member forming a sheet supply cassette detachably mounted on the body of the sheet supplying device.

5. A device according to claim 4, wherein said engagement means causes the engagement of said one reference guide member and said transport reference guide means, in linkage with the mounting operation of said sheet supply cassette on the body of the sheet supplying device.

6. A device according to claim 5, further comprising a reversion portion, wherein the sheet fed out by said sheet supply means from said sheet support means is reversingly transported by said reversion portion.

7. A device according to claim 6, wherein said transport reference guide means is provided in said reversion portion, and said transport reference guide means and said, one reference guide member are provided along the vertical direction.

8. A device according to claim 7, wherein said engagement means is comprised of an inclined face provided on said transport reference guide means, an inclined face provided on said one reference guide member, and an elastic member for biasing said sheet supplying cassette to bring the inclined face of the one reference guide member in contact with that of the transport reference guide means and maintaining the sheet regulating surface of said one reference guide member and the sheet guiding surface of said transport reference guide means in a same plane.

9. An image forming apparatus comprising:

sheet support means for supporting sheets;

sheet supply means, disposed at a position offset from a centerline of the sheets in a widthwise direction thereof, for supplying in a sheet supplying direction a sheet from the sheets supported by said sheet support means;

a plurality of reference guide members, arranged along the sheet supplying direction, for regulating one lateral end of the sheets supported by said sheet support means, said reference guide members defining the position of the sheets supported by said sheet support means in such a manner that said sheets are supported inclined at a predetermined angle with respect to the sheet supplying direction;

transport reference guide means for guiding one lateral end of the sheet supplied by said sheet supply means;

transport means for transporting the sheet supplied by said sheet supply means while urging the one lateral end of the sheet against the transport reference guide means; and engagement means for engaging with one of said reference guide members at its most downstream side and with said transport reference guide means to maintain a sheet regulating surface of said one reference guide member and a sheet guiding surface of said transport reference guide means in a same plane; and image forming means for forming an image on the sheets transported along said transport reference guide means.

10. An apparatus according to claim 9, wherein the inclination angle of said sheets is such as to rotate the sheet upon feed-out from the sheet supply means, whereby a lateral end of the thus rotated sheet becomes parallel to the sheet supplying direction.

11. An apparatus according to claim 10, further comprising a reversion portion for reversingly transporting the sheet supplied by said sheet supply means to said image forming means, and said transport means is provided in said reversion portion.

12. A sheet supply device, comprising:

sheet support means for supporting sheets;

sheet supply means for supplying in a sheet supplying direction a sheet from the sheets supported by said sheet support means;

reference guide means including a sheet guiding surface disposed on said sheet support means for guiding one lateral edge of the sheet fed by said sheet supply means;

a reversion path for reversing the sheet fed by by said sheet supply means;

transport reference guide means including a sheet guiding surface disposed at said reversion path for guiding the sheet transported in said reversion path; and engagement means for directly engaging said reference guide means with said transport reference guide means to maintain their respective sheet guiding surfaces in a same plane.

13. A device according to claim 12, wherein said engagement means comprises a first inclined face provided on said transport reference guide means, a second inclined face provided on said reference guide means, and an elastic means for biasing said sheet support means to bring the first inclined face of the reference guide means in contact with the second inclined face of the transport reference guide means.

14. A device according to claim 12, wherein said sheet support means is a sheet cassette detachably mounted on a main body of the device, said sheet cassette comprising a frame member and a support plate in said frame member for supporting the sheets.

15. A device according to claim 14, wherein a drawing out direction of said sheet cassette from said main body is the same as the sheet supplying direction by said sheet supply means.

16. An image forming apparatus comprising:

sheet support means for supporting sheets;

sheet supply means for supplying in a sheet supplying direction a sheet from the sheets supported by said sheet support means;

reference guide means including a sheet guiding surface disposed on said sheet support means for guiding one lateral edge of the sheet fed by said sheet supply means;

a reversion path for reversing the sheet fed by said sheet supply means;

transport reference guide means including a sheet guiding surface disposed in said reversion path for guiding the sheet transported in said reversion path; and engagement means for directly engaging said reference guide means with said transport reference guide means to maintain their respective sheet guiding surfaces in a same plane; and image forming means for forming an image on the sheet transported along said transport reference guide means.

* * * * *

UNITED STATES PATENT AND TRADEMARK OFFICE

CERTIFICATE OF CORRECTION

PATENT NO. : 5,651,540
DATED : July 29, 1997
INVENTOR(S) : Yoshiaki WATANABE, et al.

It is certified that error appears in the above-identified patent and that said Letters Patent is hereby corrected as shown below:

Title Page, [57], Abstract, after "supply", line 2, insert--device--.

Column 5, line 14, delete "sevaral" and insert therefor --several--;
Line 21, delete "refernece" and insert therefor --reference--.

Column 6, line 20, delete "reference plate" and insert therefor --transport reference guide--.

Column 9, line 11, insert a dash ("-") between "down" and "stream";
Line 41, delete the comma (",").

Column 10, line 10, insert a dash ("-") between "down" and "stream";
Line 36, delete "by", second occurrence.

Signed and Sealed this

Tenth Day of February, 1998

*Attest:*

*Attesting Officer*

BRUCE LEHMAN

*Commissioner of Patents and Trademarks*